US005739458A

United States Patent [19]

Girard

[11] Patent Number: 5,739,458

[45] Date of Patent: Apr. 14, 1998

[54] PROTECTION DEVICES FOR A VEHICLE OR STRUCTURE AND METHOD

[75] Inventor: Philippe Girard, Bourges, France

[73] Assignee: Giat Industries, Versailles, France

[21] Appl. No.: 556,146

[22] Filed: Nov. 9, 1995

[30] Foreign Application Priority Data

Nov. 30, 1994 [FR] France ..... 94 14344

[51] Int. Cl.[6] ..... F41H 5/00; F41H 13/00

[52] U.S. Cl. ..... 89/36.02; 89/36.04; 89/36.07; 89/36.08

[58] Field of Search ..... 89/36.01, 36.02, 89/36.04, 36.08, 36.09, 36.11, 36.12, 36.16, 36.17; 109/20, 29, 49.5, 51; 293/12, 13, 109; 244/121

[56] References Cited

U.S. PATENT DOCUMENTS

| | | | |
|---|---|---|---|
| 3,086,753 | 4/1963 | Cushman | 89/36.04 |
| 3,588,142 | 6/1971 | Gorman | 280/150 |
| 3,708,194 | 1/1973 | Amit | 293/1 |
| 3,745,938 | 7/1973 | Hathaway et al. | 109/49.5 |
| 3,822,076 | 7/1974 | Mercier | 293/1 |
| 3,893,368 | 7/1975 | Wales, Jr. | 89/36.08 |
| 4,196,668 | 4/1980 | Morlock et al. | 102/473 |
| 4,518,183 | 5/1985 | Lee | 293/118 |
| 4,543,872 | 10/1985 | Graham et al. | 109/49.5 |
| 4,741,244 | 5/1988 | Ratner et al. | 89/36.17 |
| 4,971,269 | 11/1990 | Koda | 244/158 R |
| 5,025,707 | 6/1991 | Gonzales | 89/36.17 |
| 5,062,367 | 11/1991 | Hayashi et al. | 102/530 |
| 5,190,248 | 3/1993 | Lee | 244/121 |
| 5,217,185 | 6/1993 | Rucker | 244/121 |
| 5,424,747 | 6/1995 | Chazelas et al. | 342/70 |

FOREIGN PATENT DOCUMENTS

| | | |
|---|---|---|
| 0 070 074 | 1/1983 | European Pat. Off. . |
| 0 509 655 | 10/1992 | European Pat. Off. . |
| 0 529 371 | 3/1993 | European Pat. Off. . |
| 2 552 870 | 4/1985 | France . |
| 2 691 706 | 12/1993 | France . |
| 2 697 079 | 4/1994 | France . |
| 977 984 | 9/1974 | Germany . |
| 24 09 876 | 9/1975 | Germany . |
| 25 07 351 | 9/1976 | Germany . |
| 26 11 163 | 10/1977 | Germany . |
| 33 37 115 | 2/1988 | Germany . |
| 43 07 160 | 9/1994 | Germany . |
| 865629 | 4/1961 | United Kingdom . |
| 1 421 379 | 1/1976 | United Kingdom . |
| 88/00882 | 2/1988 | WIPO . |

OTHER PUBLICATIONS

Webster's New Riverside University Dictionary, pp. 1150, 1133, 1994.

*Primary Examiner*—Daniel T. Pihulic
*Assistant Examiner*—Christopher K. Montgomery
*Attorney, Agent, or Firm*—Oliff & Berridge, P.L.C.

[57] ABSTRACT

A device for protecting a vehicle or structure against attack by a shaped-charge munition includes at least one deployable bag fastened on an external wall of the vehicle or structure. The bag is inflated by a generator in response to the detection of an attack. As a result, the invention provides an effective protection against attack by shaped-charge munitions whatever the angle of incidence of these charges.

22 Claims, 5 Drawing Sheets

PROTECTION DEVICES FOR A VEHICLE OR STRUCTURE AND METHOD

BACKGROUND OF THE INVENTION

The scope of the present invention is that of protection devices for a vehicle or structure against attack by a shaped-charge munition.

Protection devices which consist of supplementary armour, called reactive armour, are already known. In a known manner, this armour comprises a sheet of explosive placed between two metal plates (see, for example, patent U.S. Pat. No. 4,741,244).

The impact of the dart of a shaped charge on such an armour causes the initiation of the explosive and the projection of a metal plate against the dart.

The projected plate consumes the dart which reduces its piercing power with respect to the vehicle wall.

Such armours are efficient, but their detonating properties impose constraints from the safety and storage point of view. On functioning, they may also cause injury to the soldiers who are in the vicinity of the vehicle.

Moreover, their initiation causes a substantial shock to the vehicle which makes them ill-adapted to use on light vehicles or slightly-armoured vehicles. They are all the more ill-adapted in that they have a high mass.

The initiation is triggered by the impact of the shaped-charge dart itself, i.e. when the charge comes into contact with the vehicle. In this case it is primordial to provide the vehicle with a relatively substantial explosive mass to ensure that the dart is fully consumed, otherwise there is the risk that the residual effectiveness of the latter would be enough to cause damage to the vehicle.

Lastly, the effectiveness of this type of armour is not guaranteed when the dart hits the armour plate at a certain angle of incidence. Thus a dart perpendicular to a reactive armour would pierce it without being significantly diminished.

It is therefore difficult using known reactive armour to ensure the protection of vehicle roofs against attack from shaped-charge sub-munitions scattered by vectors such as artillery shells, rockets or missiles.

Protection devices are also known, for example by patents DE2409876 and DE2507351, which employ nets or chains design to cause the initiation of the shaped charge at a great distance from the vehicle.

Such devices are both heavy and unwieldy, they must be kept permanently deployed in order to be effective and thus prejudice the mobility and stealth of the vehicle.

SUMMARY OF THE INVENTION

The aim of the present invention is to propose a protection device for a vehicle, or for a structure such as a building, which does not have such disadvantages.

The invention thus provides an effective protection against attack by shaped-charge munitions whatever the angle of incidences of these charges.

The invention also enables such a protection to be applied to light vehicles or structures without the risk of inflicting injury to the occupying persons and without using explosive materials.

The invention also improves the effectiveness of known reactive armour, notably against warhead having several shaped charges mounted in tandem (charge described, for example, in patent FR2552870).

The subject of the invention is thus a protection device for a vehicle or structure against attack by shaped-charge munitions, a device characterised in that it comprises at least one deployable bag fastened to an outer wall of the vehicle or structure, a bag which can be inflated by means of a generator in response to the detection of an attack.

According to a first embodiment of the invention, the generator is a generator of a polymerizable foam, a foam which inflates the bag before solidifying.

According to another embodiment of the invention, the generator is a pressurized gas tank connected to the bag by a valve.

Each deployable bag may, with advantage, be placed in a case which is fastened to the outer wall of the vehicle or structure by a dismountable connecting means.

According to one alternative, the connecting means may be released from inside the structure or vehicle.

According to another embodiment of the invention, the deployable bag may cover a reactive armour. This alternative enables the effectiveness of the reactive armour to be improved against warheads having several shaped charges mounted in tandem.

The device according to the invention shall comprise at least one threat detector which could automatically control the inflation of at least one bag.

According to a practical embodiment, the device designed to protect a vehicle shall comprise at least one deployable bag placed on the vehicle roof.

It could comprise at least one deployable bag on at least one lateral or front wall of the vehicle.

BRIEF DESCRIPTION OF THE DRAWINGS

The invention will be better understood after reading the description of the particular embodiments, a description made with reference to the appended drawings wherein.

DESCRIPTION OF PREFERRED EMBODIMENTS

Figure 1:
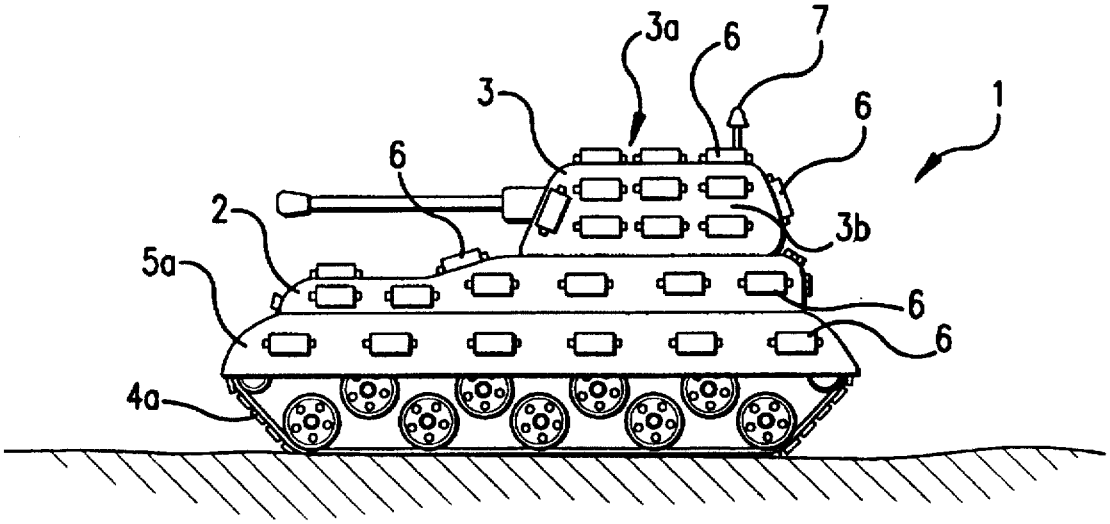
FIG. 1 shows a view in profile of a vehicle fitted with a protection device according to the invention.
Figure 2:
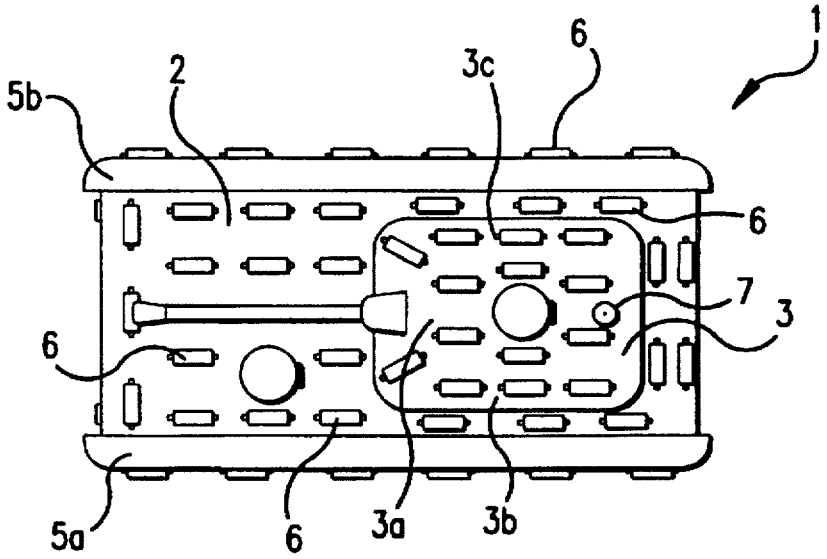
FIG. 2 is a top view of the vehicle shown in FIG. 1.
Figure 2A:
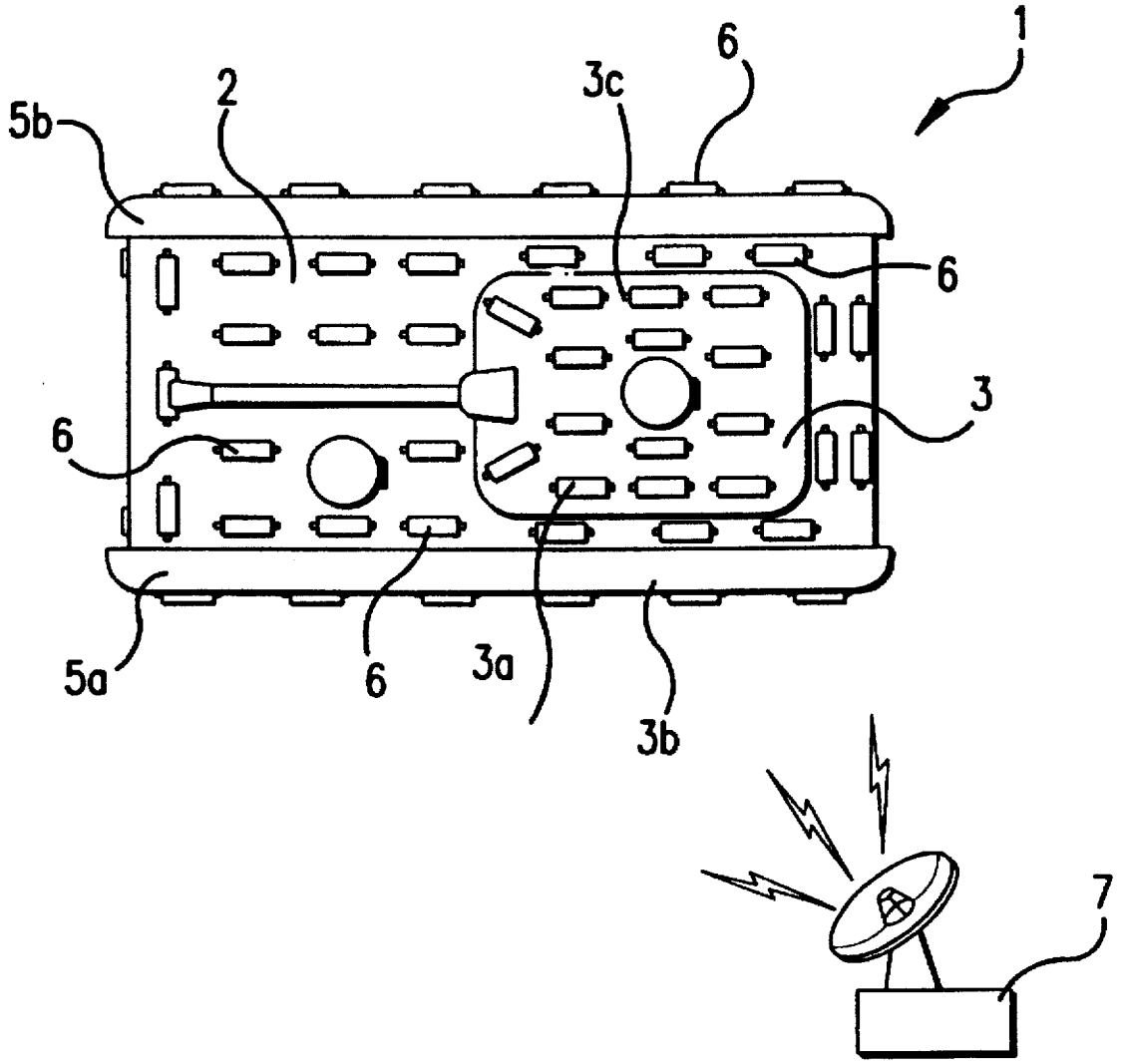
FIG. 2*a* shows a top view of a vehicle according to an alternate embodiment of the invention.

With reference to FIGS. 1 and 2, a vehicle 1, such as a light tracked armoured vehicle, comprises a chassis 2 on which a turret 3 is mounted. The tracks 4*a* and 4*b* are protected by side panels 5*a*, 5*b*.

This vehicle is fitted with a protection device according to the invention which comprises protection cases 6 distributed over the roof 3*a* and the sides 3*b*, 3*c* of the turret, as well as over the chassis 2 and the side panels 5*a*, 5*b*.

The protection device also comprises a threat detector 7 which is mounted on the roof 3*a* and which could, for example, comprise several radar systems set in different surveillance directions.

The purpose of the threat detector is firstly, to detect the approach of shaped-charge munitions and secondly, to determine the direction of attack (from the roof, from the left side or right side, or from the front).

The protection device lastly comprises an electronic control module (not shown) which capts the information sent by the threat detector and which determines which protection case or cases must be activated in response to the detected threat.

The electronic module will preferably be placed inside the vehicle and it could comprise a device to visualize the direction of the threat and a hand-driven back-up control to activate the cases.

Figure 3:
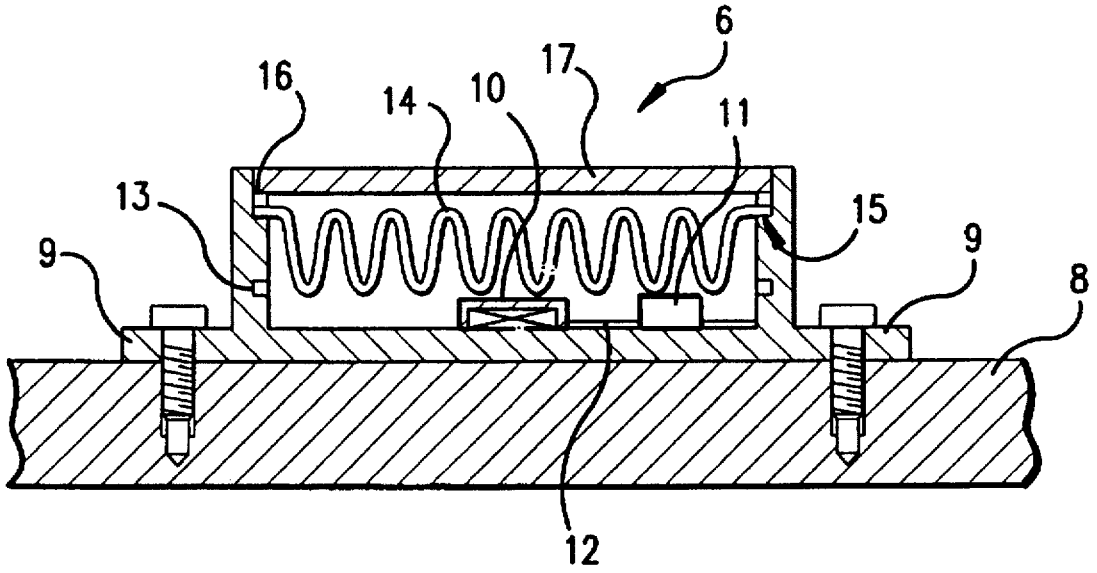
FIG. 3 shows a diagram of a case implemented in the device according to the invention.

FIG. 3 shows in diagram form a case 6 fastened to a wall 8 of the vehicle.

In this example, the case is of a roughly parallelepiped shape and is, for example, made of a plastic material (another shape could naturally be chosen for the case, for example, a cylindrical shape). It has fastening hooks 9 which enable it to be fastened in a dismountable manner onto the wall 8, for example, using screws.

The case 6 contains a gas generator 10 of the pyrotechnic type. This generator contains a gas-generating composition as well as an electric igniter (not shown). The composition will be selected from among compositions which generate a large volume of gas with a restricted rise in temperature, for example, a composition based on sodium azide.

The igniter is connected to an electronic trigger circuit 11 by a conducting wire 12.

The gas generator is designed to inflate a bag 14 which is folded up inside the case 6. The bag is pinched at its edge between a rim 15 of the case and a strap 16. The bag and the strap could be fastened to the case, for example, by bonding.

The bag is made of a material which is both flexible and strong, for example, a polyamide or Kevlar material, or in an elastic material such as an elastomer.

The technologies related to gas generators and to inflatable bags are well known in the field of motor vehicle safety. Reference could, for example, be made to patent EP529371 which discloses a material which may be used to make such a bag and to patents U.S. Pat. No. 5,062,367, FR2691706 and EP509655 which disclose gas generators which can be used in motor vehicle safety conditions.

The case is closed by a lid 17 made of a rigid plastic material (for example, of polyvinyl chloride), its thickness is chosen so that it is broken when the bag inflates.

An incipient fracture could, for example, be provided on the periphery of the lid 17 so as to make it easier to break.

The purpose of the trigger circuit 11 is to cause the initiation of the gas generator in response to a command received from the control module.

In the embodiment shown here, the trigger circuit receives commands from the control module by means of an antenna 13 housed in a groove arranged in the wall of the case 6.

In the event that the case is made of metal, the antenna shall be placed on the outside of the case.

The trigger circuit 11 shall comprise: a power source (such as a battery), a receiver stage, a decoding circuit, and a programmable memory in which information regarding the position of the case on the vehicle will be programmed.

This information is introduced when the case is mounted onto the vehicle, for example, by means of a multi-position switch. This enables the following cases to be differentiated: case on the roof, case on a left wall, case on a right wall, case on the chassis and to the front of the vehicle.

The trigger circuit 11 will also comprise a computer which enables the command received by radio from the control module to be compared with the positioning information programmed into the memory and enables the initiation of the gas generator to be commanded or not.

Figure 4A:
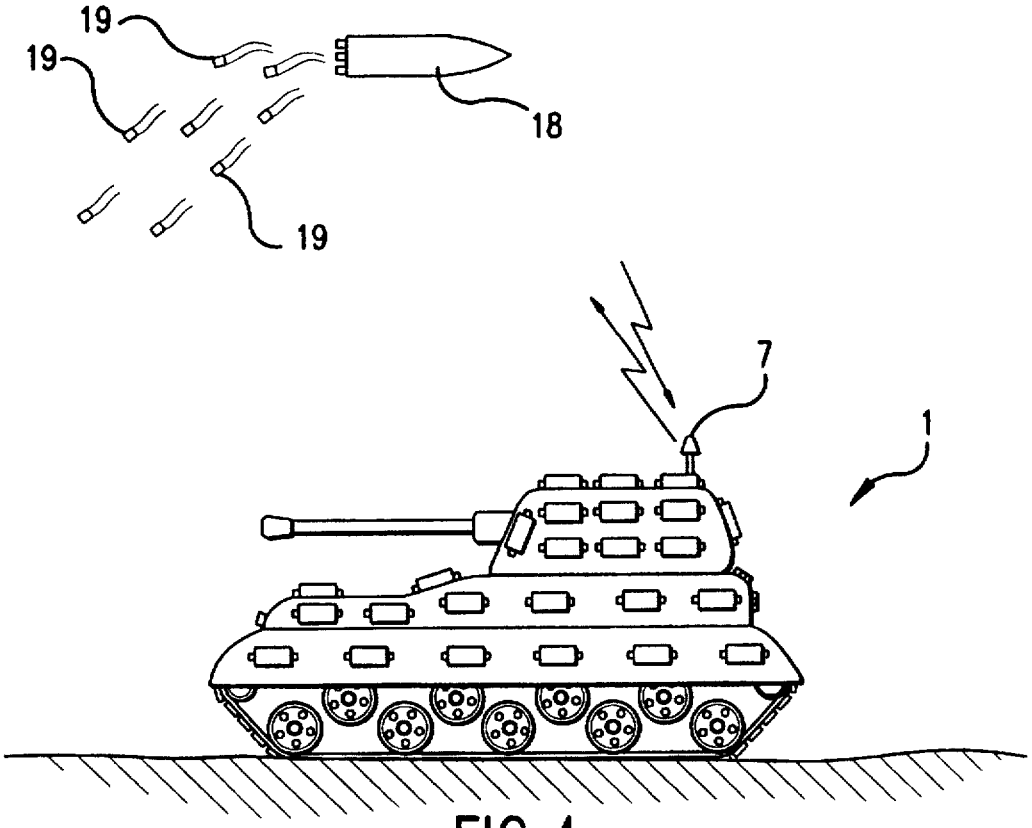
FIGS. 4*a* and 4*b* show how the protection device according to the invention functions.

The mode of operation of the device according to the invention will now be described with reference to FIGS. 4*a* and 4*b*.

A rocket 18 passes over the vehicle 1 and releases shaped-charge sub-munitions above it (for example, bomblets of the type disclosed by patent FR2697079).

The threat detector 7 detects the approach of the sub-munitions 19 from above the vehicle.

In response to this threat, it commands the inflation of all the bags in the case 6 which are placed on the upper part of the vehicle, or on the turret roof and on the top of the chassis (notably on the front and side glacis plates).

Figure 4B:
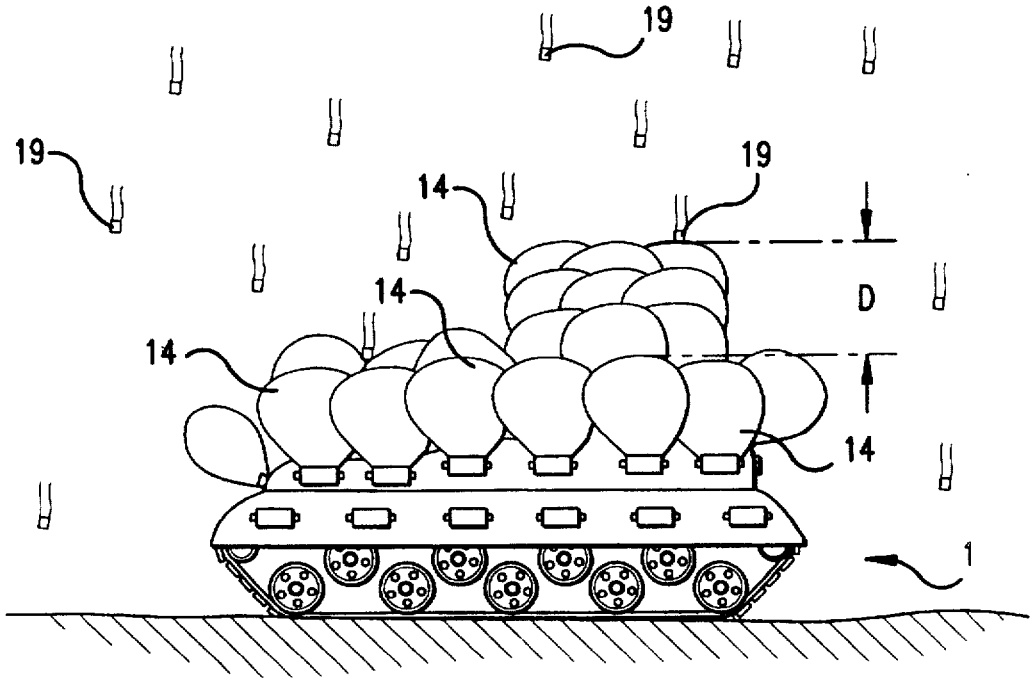
Figure 5:
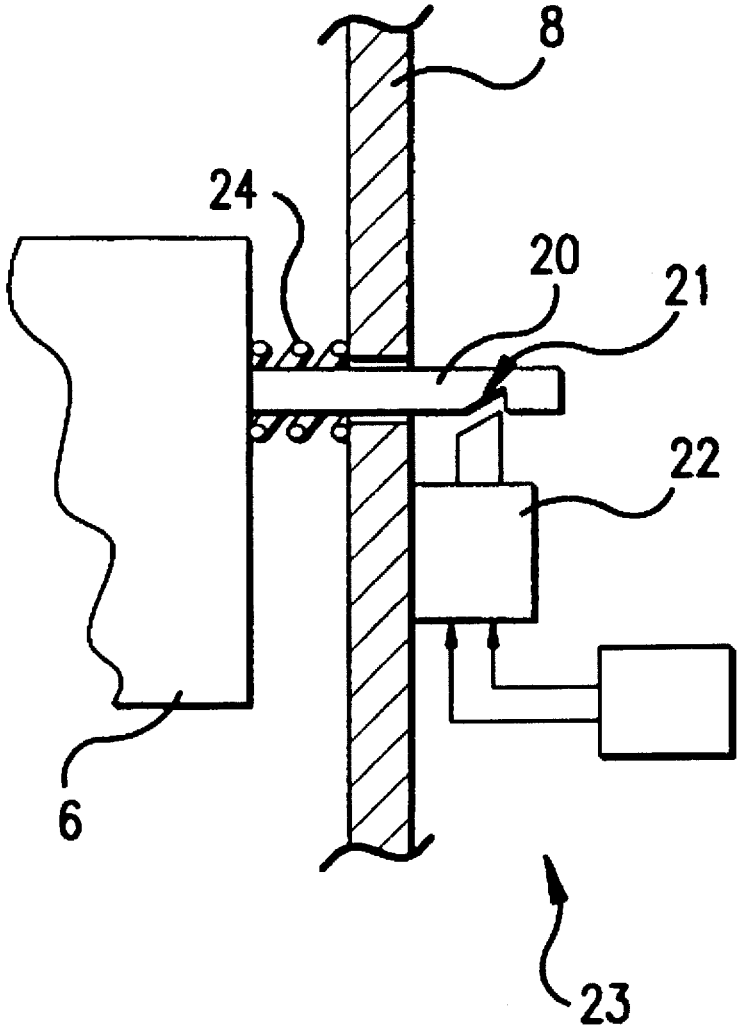
FIG. 5 is a cross-sectional view showing a release mechanism for the protection device of the present invention.

FIG. 4*b* shows the vehicle after inflation of the bags in question. The volume of the bags has been chosen such that, after their deployment, they occupy a volume such that the sub-munitions are not able to come into contact with the vehicle, at least not on the vulnerable parts (turret, motorization).

The impact of a sub-munition on a bag will cause its initiation because of the deceleration which occurs. A gas pressure will be provided which gives enough rigidity to the bag to enable such an initiation to take place. The rigidity of the usual motor vehicle safety bags is enough to perform this function.

The volume of the bags is also chosen such that, upon impact of a sub-munition on a bag, the latter is found at a distance D from the vehicle wall which is greater than the distance of optimal efficiency of the charge (which is usually of around 2 to 4 calibres).

For 40 mm calibre sub-munitions, we may see that the bags merely have to ensure a distance D greater or equal to 160 mm to be able to significantly reduce the piercing capacity of shaped charges.

It may be noted that the incidence of impact of the sub-munition on the bag has no effect on the effectiveness of the protection, the initiation of the charge is ensured at a great enough distance from the vehicle.

The bags inflated by a pyrotechnic generator usually deploy in thirty or so milliseconds (motor vehicle technology). As may be seen, for a sub-munition falling at a velocity of 50 m/s, it is possible to effectively trigger the deployment of the bags when the nearest sub-munition is less than 2 m from the vehicle. It is therefore possible to choose a threat detector having a reduced range (from 2 to 5 m), thereby limiting the power consumption of the latter and decreasing the signature of the vehicle.

Furthermore, the inflation only occurs if required, i.e. when there is a very high probability that the vehicle will be hit by a sub-munition (the detection of the sub-munitions being carried out at a small distance).

In the event that the vehicle is attacked from the side or the front by a missile, a rocket or grenade, the threat detector will determine the direction of the attack and the control module will then activate the inflation of the bags in the cases placed to the front of the chassis or on the side walls in question (right or left) or possibly all the bags so as to counter a missile able to attack from the roof.

For a rocket or missile which travels at 300 m/s, the threat detector would have to have a range of around 50 m. Detection at this distance allows an inflation time of 150 milliseconds, which allows larger-sized bags to be envisaged or bags using a specific inflation technology such as that described hereafter.

Different alternatives are possible without departing from the scope of the invention.

It is possible to provide a different number of bags, possibly only one if its volume is appropriate for the type of protection required.

It is also possible to inflate the bags using a generator of polymerizable foam, for example, polyurethane foam, rather than a gas generator. This foam will solidify and will therefore give the bag greater rigidity. Moreover, the foam will act as a composite "armour" enabling the dart to be weakened, reducing even more its residual piercing capacity.

Patent WO8800882 discloses a foam which is particularly well adapted to the inflation of deployable bags, notably in the rapid creation of floats.

In this event, the performances of the detection means will naturally be adapted to the inflation and solidification times which are greater than those obtained with gas generators.

It is possible to provide bags of differing volumes or types according to their position on the vehicle so as to adapt the protection to the part of the vehicle under consideration.

Gas-inflated bags could thus be provided to protect the roof and foam-filled bags could be provided to protect the side walls.

Figure 3A:
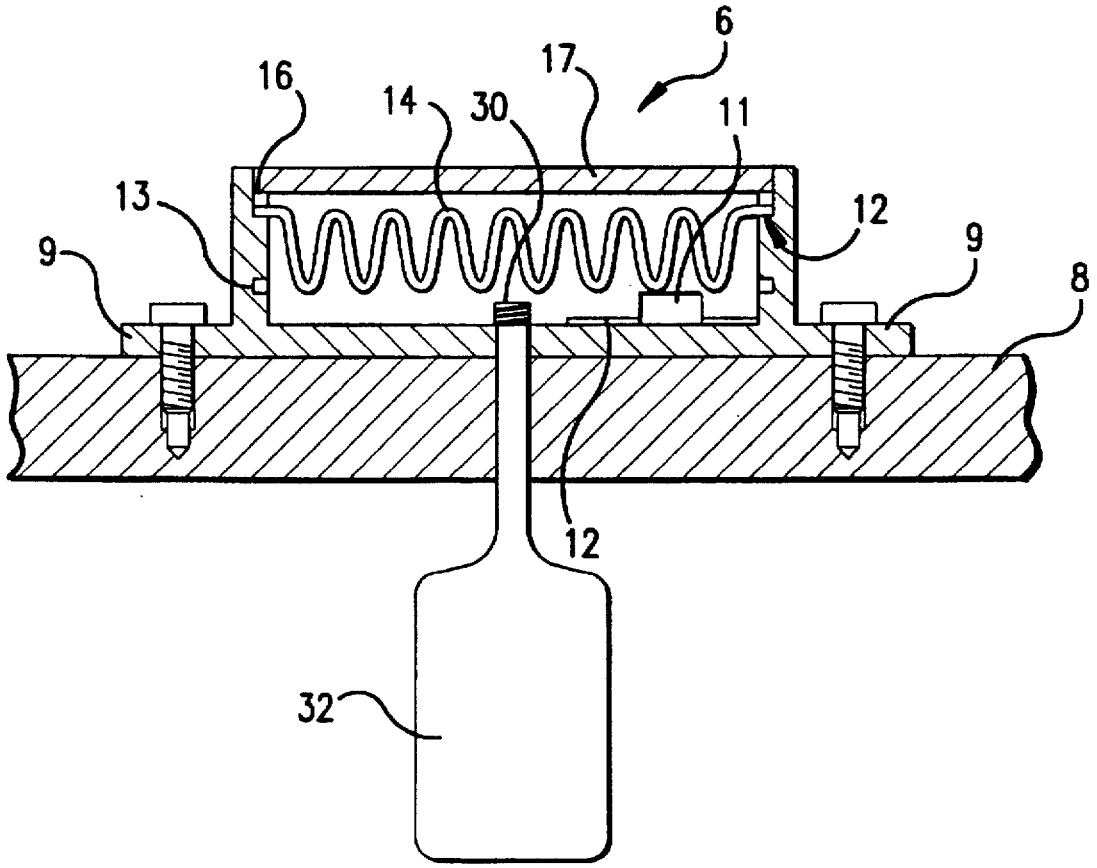
FIG. 3*a* shows a diagram of a case according to an alternate embodiment of the invention.

It is also possible to ensure inflation of the bags by means of a pressurized gas tank 32, as shown in FIG. 3*a*.

In this event, connecting nozzles linking the different cases to the gas tank will be provided.

Each case will therefore comprise a valve 30 whose opening will be controlled by a trigger circuit in the case acting in response to a command sent by the control module.

It would also be possible to replace the radio links between the control module and the cases by wire links.

It is also possible to replace or to back-up the threat detector carried by the vehicle by another threat detector placed outside of the vehicle and which have a greater range, for example a surveillance radar.

Means could be provided, with advantage, to link the cases and the vehicle which can be released from inside the structure or vehicle.

Such an arrangement allows the different used cases to be discarded from the vehicle after the attack.

Fastening could, for example, be ensured by means of cylindrical rods 20 having a hook 21 at the end, hooks which would work in conjunction with bolts 22 integral with the vehicle and electrically-controlled at 23.

Springs 24 could, in this case, be provided to facilitate the ejection of the rods 20 and the cases 6 when the bolts 22 are released.

Given their reduced volume and mass, spare cases could be provided on-board the vehicle.

It is also possible to use cases which combine an inflatable bag with a reactive armour of a known type. Such an alternative will enable warheads having shaped-charges mounted in tandem (see, for example, patent FR2552870 which discloses such charges) to be countered. The front charge, generally of a small calibre will thus be triggered at a distance from the reactive armour by its coming into contact with the bag. It will not be able to trigger the explosive of the reactive armour which will thus maintain its full effectiveness to counter the main charge.

In concrete terms, for this alternative a case merely has to be designed in which the bottom is made of a reactive armour. The inflatable bag thus covers the reactive armour thereby protecting it.

The device according to the invention may naturally be used to protect immobile structures such as buildings and hangars, and mobiles shelters.

I claim:

1. A device for protecting an object, having at least one external surface, against attack by a munition, comprising:

at least one mounting member retaining a deployable bag, the mounting member removably fastened to the at least one external surface of the object;

a generator for inflating the bag during attack and before impact of the munition on the at least one external surface; and a threat detector in communication with the at least one mounting member for detecting and outputting a signal indicating attack from one of at least two detected directions of attack to said generator, wherein said generator is responsive to said signal to inflate the bag and cause the munition to explode before impact with said at least one external surface.

2. The device according to claim 1, wherein the at least one mounting mechanism further contains a triggering mechanism responsive to the threat detector.

3. The device according to claim 1, wherein the generator is a pyrotechnic gas generator that generates a gas to inflate the deployable bag.

4. The device according to claim 1, wherein the generator is a pressurized gas tank connected to the deployable bag by a valve.

5. The device according to claim 1, further comprising a release mechanism within the object for releasing the mounting member from the at least one external surface of the object.

6. A protective device for protecting an object having at least one external surface against attack by a munition, comprising:

at least one mounting member retaining a deployable bag, the mounting member removably fastened to the at least one external surface of the object;

a generator for inflating the bag during attack before impact of the munition on the at least one external surface; and a threat detector positioned on the at least one external surface of the object and indicating attack from one of at least two detected directions of attack, wherein said generator is responsive to the indicated attack to inflate the bag and cause the munition to explode before impact with said at least one external surface.

7. The device according to claim 6, wherein the at least one external surface of the object is one of a roof, a side wall and a front wall of the object.

8. The device according to claim 6, wherein the object is a vehicle.

9. The device according to claim 6, wherein the object is a building.

10. A method for protecting an object, having at least one external surface, against attack by a munition, comprising:

mounting at least one mounting member retaining a deployable bag to the at least one external surface;

detecting and outputting a signal indicating attack from one of at least two detected directions of attack; and inflating the deployable bag on the basis of this signal to cause the munition to explode before impact upon the at least one external surface.

11. The method according to claim 10, wherein the step of inflating the deployable bag includes a step of generating a gas to inflate the deployable bag.

12. The method according to claim 10, wherein the step of inflating the deployable bag includes a step of generating a foam to inflate the deployable bag.

13. A device for protecting an object, having at least one external surface, against attack by a munition, comprising:.

means for mounting at least one mounting member retaining a deployable bag to the at least one external surface;

means for detecting and outputting a signal indicating attack from one of at least two detected directions of attack; and means for inflating the deployable bag on the basis of the signal to cause the munition to explode before impact upon the at least one external surface.

14. The device according to claim 13, further comprising:

means for triggering the means for inflating the deployable bag in response to the signal from the means for detecting.

15. A device for protecting an object, having at least one external surface, against attack by a munition comprising:

at least one mounting member retaining a deployable bag and having a base that is reactive armor, the mounting member removably fastened to the at least one external surface; and a generator for inflating the bag during attack and before impact of the munition on the at least one external surface.

16. A protective device for protecting an object having at least one external surface against attack by a munition, comprising:

at least one mounting member retaining a deployable bag, the mounting member removably fastened to the at least one external surface of the object;

a generator for inflating the bag during attack before impact of the munition on the at least one external surface; and a threat detector positioned apart from the object, the threat detector detecting a signal indicating attack and direction of attack and connected to the at least one mounting member for communicating the signal.

17. A device for protecting an object, having at least one external surface, against attack by a munition, comprising:

means for mounting at least one mounting member retaining a deployable bag to the at least one external surface;

means positioned apart from the object for detecting and outputting a signal indicating attack and direction of attack; and means for inflating the deployable bag on the basis of the signal.

18. A device for protecting an object, having at least one external surface, against attack by a munition, comprising:

at least one mounting member retaining a deployable bag, the mounting member removably fastened to the at least one external surface of the object;

a generator for inflating the bag during attack before impact of the munition on the at least one external surface; and a threat detector in communication with the at least one mounting member for detecting and outputting a signal indicating attack from at least one detected direction of attack and wherein the deployable bag causes the initiation of the munition at a distance from the vehicle which is greater than the distance for optimal efficiency of the munition.

19. The device according to claim 18, wherein the at least one mounting member further contains a triggering mechanism responsive to the threat detector.

20. The device according to claim 19, wherein the generator is a pyrotechnic gas generator that generates a gas to inflate the deployable bag.

21. The device according to claim 19 wherein the generator is a solidifying foam generator that generates a foam to inflate the deployable bag before the foam solidifies.

22. A device for protecting an object, having at least one external surface, against attack by a munition, comprising:

at least one mounting member retaining a deployable bag, the mounting member removably fastened to the at least one external surface of the object;

a solidifying foam generator that generates a foam to inflate the deployable bag before the foam solidifies and before impact of the munition on the at least one external surface; and a threat detector in communication with the at least one mounting member for detecting and outputting a signal indicating attack from one of at least two detected directions of attack.

* * * * *